United States Patent [19]

Hochgesang

[11] 4,114,002

[45] Sep. 12, 1978

[54] ELECTRIC SWITCH

[75] Inventor: Gerhard Hochgesang, Lebenhan, Fed. Rep. of Germany

[73] Assignee: Preh-Elektrofeinmechanische Werke-Jakob Preh Nachf, Bad Neustadt, Saale, Fed. Rep. of Germany

[21] Appl. No.: 707,337

[22] Filed: Jul. 21, 1976

[30] Foreign Application Priority Data

Aug. 16, 1975 [DE] Fed. Rep. of Germany ..... 2536603

[51] Int. Cl.[2] ..... H01H 1/24

[52] U.S. Cl. ..... 200/67 C; 200/11 K; 200/14; 200/67 D; 200/247; 200/275

[58] Field of Search ..... 200/67 C, 67 DB, 154, 200/239, 245, 246, 247, 249, 275, 276, 11 K, 14, 273, 67 R, 250, 243, 244

[56] References Cited

U.S. PATENT DOCUMENTS

| | | | |
|---|---|---|---|
| 1,818,987 | 8/1931 | Duffy | 200/11 K |
| 2,945,927 | 7/1960 | Mason | 200/68 |
| 3,177,306 | 4/1965 | Mastney | 200/14 |
| 3,259,709 | 7/1966 | Hemmens | 200/275 |
| 3,271,534 | 9/1966 | McFadden | 200/275 |
| 3,274,355 | 9/1966 | Francy | 200/275 |
| 3,946,185 | 3/1976 | Gruner | 200/245 |

*Primary Examiner*—Samuel W. Engle
*Assistant Examiner*—Ralph Palo
*Attorney, Agent, or Firm*—Wigman & Cohen

[57] ABSTRACT

An electrical switch having conductive contact elements each pivoted about a stationary middle contact block is disclosed. The contact elements are each formed as a triangular spring open at one apex and having a bearing the side thereof opposite the open apex for engaging its respective middle contact block. The other two sides of each spring, depending on the switch position, rest under spring tension against one or the other of stationary contact blocks arranged on either side of its respective middle contact block. The ends of these two sides adjacent the open apex are formed with hooks which are positioned with a minimum of friction in recesses and oblong openings in a rotatable actuating element, under spring tension, in such a way that the contact element serves to produce a snap action as the actuating element is rotated.

12 Claims, 4 Drawing Figures

ELECTRIC SWITCH

BACKGROUND OF THE INVENTION

This invention relates to an electrical switch having a unitary contact element pivoted around a stationary middle contact block and made of electrically-conductive material, said contact element being brought into or out of contact with stationary contact blocks in two stop positions by means of an actuating element, wherein the contact element simultaneously serves to produce a snap movement.

Switches of this type are used as throw-over switches, and they can be both unipolar or multipolar. In addition, especially in the case of rotary switches, there is the possibility of arranging several switch stages one behind the other and activating them simultaneously by means of a common stub shaft. Since these switches, which are used in electrical equipment, are needed in large quantities as so-called service switches, their design must be as simple as possible, while at the same time they must be suitable for multifarious uses. Moreover, the contact terminals are generally designed in such a way that the switches can be installed in the circuit board of a printed circuit.

To make the construction of the switches as simple and inexpensive as possible, the technique of using contact springs simultaneously to produce a snap movement has already been developed. Thus, in a known miniature switch suitable for mounting in the circuit board of a printed circuit, the actuating element bears a contact bridge which, in each switch position, rests under spring pressure against a middle contact block and a contact block, or, after movement over the cams of the middle contact block, rests against another contact block, wherein the contact bridge is designed as a spiral spring that rotates around a bolt-like pivot. The contact blocks and the middle contact block are connected electrically with the conducting elements of the printed circuit, while the pivot is only mechanically attached to the circuit board. The two ends of the spiral spring are bent outwardly, so that one end serves as the contact bridge, while the other end leads to the actuating element. A disadvantage of this switch is that it can be used only as a unipolar throw-over switch, and is thus limited to one application possibility.

Also known is a unipolar or multipolar slide throw-over switch consisting of a plastic housing from the bottom of which terminals project. The peak coil of a V-shaped wire spring serving as a contact bridge is loosely attached inside the housing by means of a middle terminal. The two equally long sides of the V-shaped wire which exert the spring pressure, alternately rest against one of the other two terminals, and all three terminals form a triangle. The wire spring only serves as a contact bridge, so that tongues or barriers formed on the sides of the slide bar and equipped with cams are needed for catching on the housing.

SUMMARY AND OBJECTS OF THE INVENTION

It is an object of the invention to provide a unipolar or multipolar switch consisting of very few individual parts, which would thus be inexpensive to make, and in which the contact spring serves simultaneously to produce a snap movement and in which the attachment of the contact spring to the middle contact block that forms the pivot and to the actuating element is executed in such a way that a reliable contact is guaranteed.

This problem is solved by the invention in that the contact element is a contact spring approximately in the shape of a triangle, open at one point of the triangle. In the center of one side of the contact spring there is a bearing for the middle contact block, while the other two sides of the contact spring, depending upon the catch position, rest under spring tension against the contact blocks on either side of the middle contact block. The free ends of the contact spring sides are inserted with a minimum of friction in a recess in the actuating element, under spring tension, in such a way that the end of the non-contacting contact spring side rests against one of the end stops of the recess, while the end of the contacting contact spring side is limited by the fact that it rests against its contact block between the end stops.

In a preferred embodiment of the invention, the free ends of the contact spring sides are bent in the form of hooks that catch in an oblong recess in the actuating element.

In another embodiment, the contact spring is a band spring with a bearing in the form of a U-shaped bracket that partially embraces the middle contact block.

Another embodiment provides for a contact spring in the form of a filamentary torsion spring with a bearing formed by at least one eye-like coil disposed on the inner side of the triangle and pointing to the actuating element. The contact spring can be rotated around the middle contact block with the aid of the eye-like coil.

According to yet another embodiment, the actuating element is round and has outwardly-projecting extensions along its circumference, located diametrically opposite one another. These extensions serve as stops against the contact block contacting at the moment.

The switch can be designed as a unipolar or multipolar throw-over switch.

Another feature of the invention consists in the fact that the contact blocks and the middle contact block consist of round metal pins which are fastened in an insulating material plate. These contacts have terminals projecting from the insulating plate on the opposite side of the switch and designed in such a way that the rotary switch can be mounted in a printed circuit board.

Another embodiment provides that a hollow cylindrical prolongation be formed on the actuating element; this prolongation projects through an opening in the insulating plate and is enlarged on the end that projects from the opening.

In the case of a final embodiment, the actuating element is provided with a ring-segment shaped notch on the side facing the insulating plate. The aperture angle of this notch is determined by the turning capacity of the switch; the oblong recess in the actuating element is hollowed out in the center of the inner radius of this notch, relative to the aperture angle and perpendicular to the insulating plate. The oblong recess can also be in the shape of a ring segment.

BRIEF DESCRIPTION OF THE DRAWINGS

The embodiment of the invention and other details are explained in greater detail in the following, with references to the drawings, wherein.

DETAILED DESCRIPTION OF THE INVENTION

Figure 1:
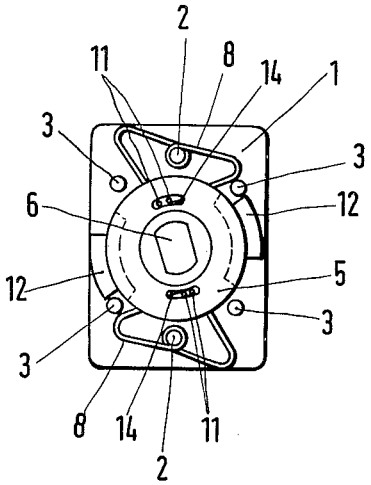
FIG. 1 shows a top view of the switch of the invention.

A bipolar throw-over switch is shown in the drawing figures, as an example of an embodiment of the invention. By changing the line-up of the contact arrangement, the switch can also be used as a unipolar throw-over switch. If several switch stages are arranged one behind the other, a multiple arrangement is formed that can be activated simultaneously by a common stub shaft. If, in place of the stub shaft, a lever is formed on the actuating element or snapped into the actuating element, perpendicular to the axis of the stub shaft, then a toggle switch is obtained.

Figure 2:
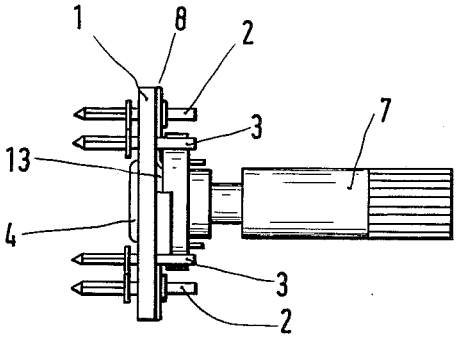
FIG. 2 shows a side view of the switch of the present invention.

Referring to FIG. 1 it can be seen that attached to an insulating plate 1 are a total of six contact blocks 2, 3, in the form of round metal pins (in the case that the switch is being used as a bipolar throw-over switch). Three each of these contact blocks are part of one contact arrangement. One contact block 3 is arranged on either side of a middle contact block 2, the latter of which forms a circuit with one or the other contact block 3. As shown in FIG. 2, the terminals of the contact blocks projecting from the bottom of the insulating plate are, in the case of this embodiment, designed in such a way that the switch can be mounted in the circuit board of a printed circuit.

The insulting plate 1 has a round opening in the center, through which a hollow cylindrical prolongation 4 of the plastic actuating element 5 projects. The end projecting from the opening is enlarged, so that the actuating element 5 is held in the insulating plate 1 in such a way that it rotates. The actuating element has a non-circular opening 6 in its center, into which a stub shaft 7 can be snapped. The shape of the opening is such that it guarantees definite locking in of the actuating element. If there are several switch stages utilized, the stub shaft is designed to project through all the actuating elements.

Figure 3:
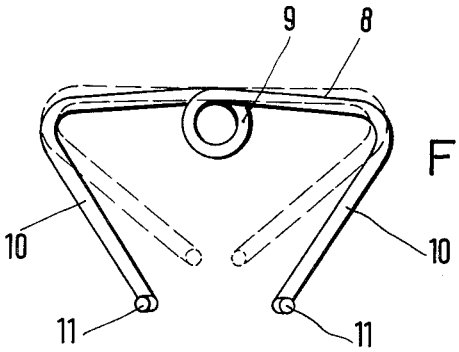
FIG. 3 shows a top view of the contact spring in enlarged scale.

An approximately triangular contact spring 8 made of wire is used as the contact element, as shown in FIG. 3. This triangle is open at one apex. In the middle of the side opposite the open apex is a bearing in the form of an eye-shaped coil 9, by means of which the contact spring 8 is attached to pivot around the middle contact block 2. The free ends 10 of two of the sides of the contact spring are bent in the shape of hooks 11. The dotted lines indicate the shape of the contact spring as it appears after installment in the switch.

The contact spring could also be made of a metal band instead of wire. The bearing would then be designed as a U-shaped bracket that partially engages the middle contact block 2.

Figure 4:
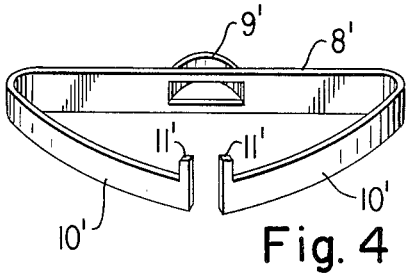
FIG. 4 shows a perspective view of the contact spring formed of a band spring and in enlarged scale.

FIG. 4 shows, in perspective, a contact spring 8' formed of a metal band or strip having sides 10' and hooks 11' corresponding to sides 10 and hooks 11, respectively, of the contact spring 8 shown in FIG. 3. Contact spring 8' is formed at the middle of the side thereof opposite the open apex of the triangle with a U-shaped bearing bracket 9' for receiving the metal contact block 2. Bearing 9' corresponds to the eye-shaped coil 9 of the spring of FIG. 3.

On the circumference of the actuating element 5, diametrically opposite one another, as FIG. 1 shows, are raised radial extensions 12, that serve as stops against the contact blocks 3. Hollowed out on the underside of the actuating element, i.e., on the side facing the insulating plate, are two oppositely disposed ring-segment shaped notches 13, the aperture angles of which are determined by the turning capacity of the switch. At the mid-points relative to the angles of aperture and radially positioned approximately in the vicinity of the internal radius of the ring-segment shaped notches, there are kidney-shaped recesses 14 that extend perpendicularly to the insulating plate 1. The hooks 11 of the contact spring fit into these recesses in such a way that they are inserted and controlled under spring tension. The end hooks 11 of the non-contacting sides of both contact springs 8 rest against one end of their associated recesses while the contacting sides of the contact springs rest under spring tension, against their respective contact blocks 3 in such a way that their hooks are located intermediately of the ends of their respective recesses 14.

If the actuating element is rotated, then the contact spring is flexed to dead center and then rotates in a sudden snap action beyond the dead center into the locking position limited by the stops 12. Preferably, the hooks are designed to be guided with a minimum of friction within the recesses.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. In an electrical switch having a single-piece contact element pivoted about a middle contact block and made of electrically-conductive material, said contact element being brought selectively into or out of contact with stationary contact blocks in two switch positions by means of an actuating element, wherein the contact element simultaneously serves to produce a snap action movement, the improvement comprising said contact element comprising a contact spring formed approximately in the shape of a triangle and open at one apex of the triangle, said contact spring having a bearing in the center of the side thereof opposite the open apex for engaging said middle contact block, a second side of the contact spring, in a first switch position, bearing under spring tension against one stationary contact block disposed on one side of the middle contact block, a third side of the contact spring, in a second switch position, bearing under spring tension against another stationary contact block disposed on another side of the middle contact block, said actuating element having a recess therein, the free ends of the second and third sides of the contact spring, at the open apex thereof, engaging in said recess.

2. The improvement according to claim 1, wherein the free ends of the sides of the contact spring include hooks disposed in the recess of the actuating element.

3. The improvement according to claim 1, wherein the contact spring comprises a band spring having a bearing in the form of a U-shaped bracket that partially engages the middle contact block.

4. The improvement according to claim 1, wherein the contact spring is a filamentary torsion spring with said bearing formed by at least one eye-like coil arranged on the inside of the spring side and oriented toward the actuating element, said eye-like coil being rotatably arranged about the middle contact block.

5. The improvement according to claim 1, wherein the actuating element is circular and has radial extensions located substantially diametrically opposite one another, said extensions comprising stops for abutting against one or the the other of said stationary contact blocks.

6. The improvement according to claim 1, wherein the switch is a unipolar throw-over switch.

7. The improvement according to claim 1, wherein the switch is a multipolar throw-over switch.

8. The improvement according to claim 1, wherein the stationary blocks and the middle contact block comprise round metal pins attached in an insulating material plate, said contact blocks having contacts which project from the insulating plate on the side thereof opposite the actuating element for mounting the switch to a printed circuit board.

9. The improvement according to claim 8, wherein a hollow cylindrical prolongation is formed on the actuating element, said prolongation projecting through an opening in the insulating plate and being enlarged on the end thereof projecting from the opening.

10. The improvement according to claim 1, wherein the actuating element includes a ring-segment shaped notch on the underside thereof adjacent the contact spring for receiving the contacting sides of the contact spring, said notch having an aperture angle determined by the turning capacity of the switch, said actuating element having recesses extending perpendicularly of the insulating plate and being hollowed-out approximately in the vicinity of the internal radius of the ring-segment shaped notch.

11. The improvement according to claim 10, wherein the recess is oblong and shaped like a segment of a ring.

12. The improvement according to claim 1, wherein said recess has ends, said free ends being engaged, under spring tension, in said recess with a minimum of friction such that the free end of the non-contacting side of the contact spring bears against one end of the recess and the free end of the contacting side of the contact spring is positioned intermediately of the ends of said recess.

* * * * *